United States Patent [19]

Freeman et al.

[11] Patent Number: 4,917,184

[45] Date of Patent: Apr. 17, 1990

[54] CEMENT HEAD AND PLUG

[75] Inventors: T. Austin Freeman; Morris G. Baldridge; David D. Szarka, all of Duncan, Okla.; Darrell E. Fontenot, Corpus Christi, Tex.

[73] Assignee: Halliburton Company, Duncan, Okla.

[21] Appl. No.: 310,439

[22] Filed: Feb. 14, 1989

[51] Int. Cl.[4] ..... E21B 33/068; E21B 23/08

[52] U.S. Cl. ..... 166/285; 166/70; 166/155; 166/291

[58] Field of Search ..... 166/285, 70, 153, 155, 166/291; 15/104.062; 137/268

[56] References Cited

U.S. PATENT DOCUMENTS

| | | | |
|---|---|---|---|
| 1,662,311 | 3/1928 | Hamer . | |
| 1,842,107 | 1/1932 | Lytle | 166/291 |
| 1,866,726 | 7/1932 | Santiago . | |
| 1,974,986 | 9/1934 | Ferlin | 220/46 |
| 2,196,652 | 4/1940 | Baker | 166/1 |
| 2,223,388 | 12/1940 | Scaramucci | 166/1 |
| 2,277,510 | 3/1942 | Courter | 166/14 |
| 2,615,519 | 10/1952 | Carr | 166/14 |
| 2,620,037 | 12/1952 | McClendon | 166/14 |
| 2,630,179 | 3/1953 | Brown | 166/14 |
| 2,647,582 | 8/1953 | Brown et al. | 166/1 |
| 2,664,163 | 12/1953 | Schnitter | 166/1 |
| 2,818,592 | 1/1958 | Scaramucci | 15/104.06 |
| 2,854,079 | 9/1958 | Schnitter | 166/70 |
| 2,870,842 | 1/1959 | Hall | 166/70 |
| 3,076,509 | 2/1963 | Burns et al. | 166/70 |
| 3,322,197 | 5/1967 | Baker et al. | 166/75 |
| 3,444,928 | 5/1969 | Pitts | 166/70 |
| 3,545,542 | 12/1970 | Scott | 166/155 |
| 3,616,850 | 11/1971 | Scott | 166/155 |
| 3,730,267 | 5/1973 | Scott | 166/291 |
| 3,863,716 | 2/1975 | Streich | 166/70 |
| 4,246,967 | 1/1981 | Harris | 166/291 |
| 4,290,482 | 9/1981 | Brisco | 166/70 |
| 4,613,161 | 9/1986 | Brisco | 285/18 |
| 4,624,312 | 11/1986 | McMullin | 166/155 |
| 4,624,483 | 11/1986 | Stromberg | 285/24 |
| 4,664,192 | 5/1987 | Hogarth | 166/291 |
| 4,809,776 | 3/1989 | Bradley | 166/155 |

OTHER PUBLICATIONS

Exhibit A (Subsurface Release Cementing Plug System).

*Primary Examiner*—Bruce M. Kisliuk

*Attorney, Agent, or Firm*—James R. Duzan; L. Wayne Beavers

[57] ABSTRACT

A cement head and casing assembly includes a cement head body having a cement passage defined therethrough. The body is mounted on the well casing and has a lower portion extending down into the casing, with an upper portion extending a relatively short distance above an upper end of the casing. A cement plug is closely received within a bore of the casing below the upper end thereof. The cement plug is releasably connected to the lower portion of the cement head body so that the plug is suspended from the lower portion of the cement head body within the casing. The cement plug has a plug passage defined therethrough which is communicated with a cement passage in the cement head body so that cement can be pumped down through the cement head body and the cement plug into the casing. The passage through the cement plug can be closed and the cement plug can be released from the cement plug body after the cement has been pumped into the casing.

13 Claims, 3 Drawing Sheets

CEMENT HEAD AND PLUG

BACKGROUND OF THE INVENTION

1. Field Of The Invention

The present invention relates generally to cementing heads for introducing cement along with cement plugs into an oil or gas well, and particularly to a cementing head adapted for use in situations where there is not sufficient room to use typical cement plug containers.

2. Description of the Prior Art

In the cementing of casing into the bore hole of an oil well, it is very common to use cement plugs which are placed at the beginning and/or end of the slug of cement that is pumped into the well. The purpose of the cement plugs is to wipe the walls of the casing and also to provide a distinct boundary between the cement and other fluids which are in front of or behind the cement.

Very typically when such cement plugs are being utilized, the plugs will initially be placed in a plug container which is mounted on top of the upper end of the well casing which extends out of the ground. The plugs are contained in the plug container along with release mechanisms which allow the plugs to be dropped into the casing at the appropriate time. These plug containers are often referred to by the more general terms cementing head or cement head.

Typical examples of such prior art plug containers are seen in U.S. Pat. No. 4,613,161 to Brisco, U.S. Pat. No. 3,863,716 to Streich, U.S. Pat. No. 2,620,037 to McClendon, U.S. Pat. No. 4,290,482 to Brisco, and U.S. Pat. No. 3,322,197 to Baker et al., all assigned to the assignee of the present invention.

With all of these prior art devices, the cementing plugs are actually contained in the plug container which sits on top of the upper end of the well casing.

One difficulty which is sometimes encountered is that at some drilling sites, the equipment being utilized does not provide sufficient clearance above the upper end of the well casing for the mounting of these standard cement plug containers.

SUMMARY OF THE INVENTION

The present invention provides an improved cementing head which only extends a relatively short distance above the upper end of the well casing. This permits the cementing head of the present invention to be utilized in situations where there is not room for the placement of a standard cement plug container. The cementing head of the present invention is not a plug container since it does not actually enclose the cement plug; instead the cement plug is suspended from the cementing head and is located inside the casing below the cementing head.

The cementing head and casing assembly of the present invention provides a cement head body having a cement passage defined therethrough. The body has a lower portion extending down into the casing and has an upper portion extending a relatively short distance above the upper end of the casing. The body includes a cement port communicated with the cement passage for introducing cement into the cement passage. The cement head body is mounted on the upper end of the well casing.

A cement plug is closely received within a bore of the casing below the upper end thereof. This plug is releasably connected to the lower portion of the cement head body so that the plug is suspended from the lower portion of the cement head body within the casing. The plug has a plug passage defined therethrough which is communicated with the cement passage, so that cement can be pumped into the cementing port, then through the cement passage, then through the plug passage down into the casing.

A releasing ball seats in the plug passage to close the plug passage and release the plug from the cement head body at a desired time.

An equalizing valve means is operably associated with the cement head body for permitting pressurized fluid trapped within the casing above the plug to communicate with the cement passage and equalize therewith so as to prevent excessive pressures from being applied downward across the entire area of the cement plug.

The cement plug also includes a ball retainer means for preventing the releasing ball from traveling upward out of the plug after the releasing ball is seated within the plug to close the plug passage.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1A:
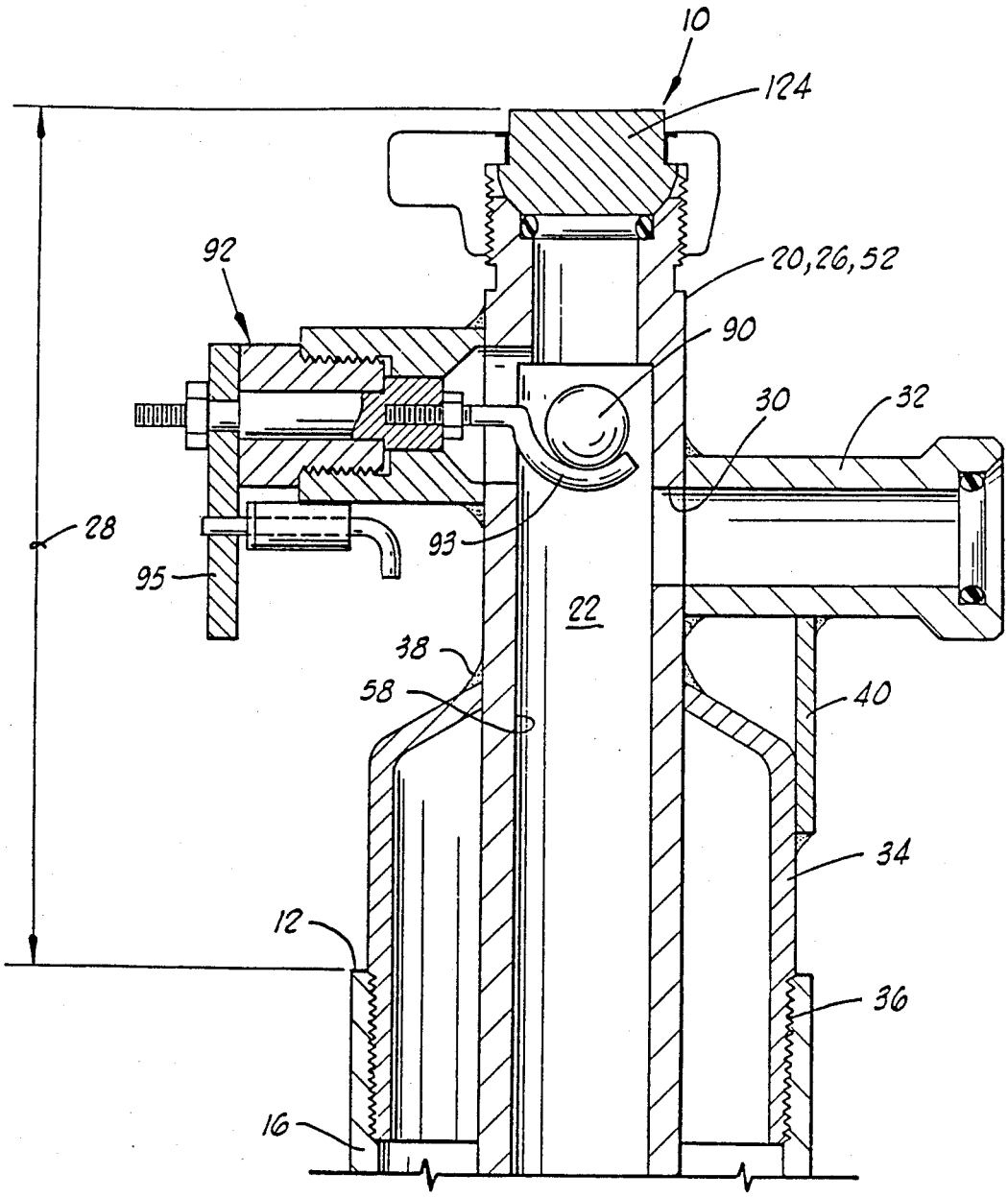
FIGS. 1A–1B comprise an elevation section view of a first embodiment of the cement head and cement plug assembly. The embodiment of FIG. 1 mounts on the upper end of the casing by threadedly engaging a casing collar.
Figure 1B:
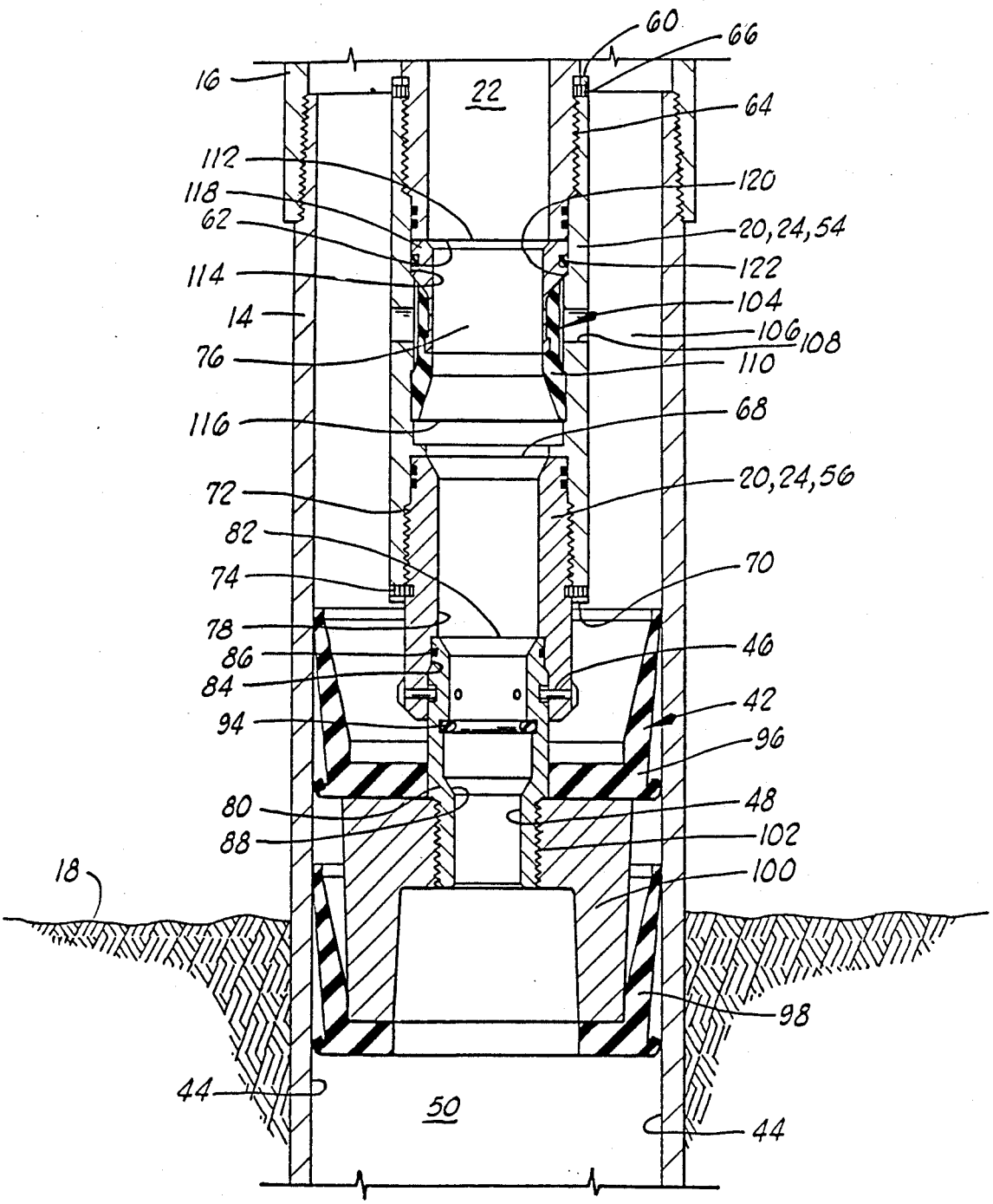

Referring now to the drawings and particularly to FIGS. 1A–1B, a cement head and plug assembly is thereshown and generally designated by the numeral 10. The assembly 10 is shown mounted on an upper end 12 of a well casing 14 by threaded engagement thereof with a casing collar 16 of the well casing 14. The upper end 12 of casing 14 extends above a ground level 18.

The cement head and plug assembly 10 includes a cement head body 20 having a cement passage 22 defined therethrough. A lower portion 24 of cement head body 20 extends down into the casing 14, and an upper portion 26 of cement head body 20 extends a relatively short distance 28 above the upper end 12 of casing 14.

The cement head body 20 includes a cement port means 30 communicated with the cement passage 22. The port means 30 is associated with a cement inlet nozzle 32 by means of which cement is introduced through the port 30 into the cement passage 22.

A mounting means 34 is provided for mounting the cement head body 20 on the upper end 12 of well casing 14. The mounting means 34 is an annular mounting ring, the lower end of which is threaded at 36. The threads 36 are engaged with the internal threads of casing collar 16 as seen in FIG. 1A. The mounting ring 34 has an upper end attached as by weld 38 to the cement head body 20. A reinforcing strut 40 is welded between the nozzle 32 and mounting ring 34.

A cement plug 42 is closely received within a bore 44 of casing 14 below the upper end 12 thereof. The cement plug 42 is releasably connected to the lower portion 24 of cement head body 20 within the casing 14 by a plurality of shear pins 46. In this manner, the cement plug 42 is suspended from the lower portion 24 of cement head body 20 within the casing 14.

The cement plug 42 has a plug passage 48 defined therethrough which is communicated with the cement passage 22 so that cement can be pumped into the cement port means 30, then through the cement passage 22, then through the plug passage 48 down into an interior 50 of the well casing 14. The cement head body 20 is comprised of a tubular body mandrel 52, a tubular equalizing mandrel 54, and a tubular releasing mandrel 56.

A portion of the cement passage 22 extends downward through the tubular body mandrel 52 and may be more specifically referred to as an upper cementing passage 58.

The tubular equalizing mandrel 54 has an upper end 60 attached to a lower end 62 of body mandrel 52 by threads 64 and set screws 66.

The tubular releasing mandrel 56 has an upper end 68 attached to a lower end 70 of equalizing mandrel 54 at threaded connection 72 and set screws 74.

The equalizing mandrel 54 has a portion of the cementing passage 22 disposed therethrough which may be generally referred to as an intermediate cementing passage 76. The tubular releasing mandrel 56 has a portion of the cementing passage 22 disposed therethrough which can be generally referred to as a lower cementing passage 78.

The cement plug 42 is located below the releasing mandrel 56 and its plug passage 48 is defined therethrough and is communicated with the lower cementing passage 78.

The cement plug 42 includes a plug mandrel 80 which has its upper end 82 closely received within a counterbore 84 of releasing mandrel 56. An O-ring seal 86 seals between the plug mandrel 80 and the counterbore 84. As previously mentioned, the plug mandrel 80 is connected to the releasing mandrel 56 by a plurality of shear pins 46 which may be generally referred to as a frangible connecting means 46 for releasably connecting the plug 42 to the cement head body 20.

The plug mandrel 80 has an annular upward facing seat 88 defined therein.

A releasing ball 90 is shown in FIG. 1A held in place by a ball release means 92 located in the upper end of the cement head body 20. When it is desired to release the cement plug 42 from the cement head body 20, the release means 92 is activated to drop the ball 90 down through the cement passage 22 until the ball 90 seats on the annular seat 88 of plug mandrel 80. Then by the exertion of additional fluid pressure downward upon the seated ball 90, a downward force is applied to the cement plug 42 thus shearing the shear pins 46 and releasing the cement plug 42 from the cement head body 20.

Ball release means 92 has a spoon 93 in which ball 90 is received. A handle 95 rotates spoon 93 to allow ball 90 to fall out of spoon 93 and drop downwards.

The plug mandrel 80 has a ball retainer means 94 located therein for preventing the releasing ball 90 from traveling back upwards out of the plug mandrel 80 after the releasing ball 90 is seated on the annular seat 88.

The ball retainer means 94 is a resilient annular ring which is located in the plug mandrel 80 above the annular seat 88 so that the releasing ball 90 must pass downward through the resilient ring 94 to reach the annular seat 88. The resilient ring 94 has an inside diameter which is smaller than an outside diameter of the releasing ball 90. The releasing ball 90 can pass downward through the resilient ring 94 due to the pressure which is applied above the ball 90. After the ball 90 has seated on the seat 88, there is a possibility that upward motion of the ball 90 relative to the plug mandrel 80 might be caused due to abrupt pressure changes within the casing 14 which would normally tend to push the ball 90 back upwards. The presence of the reduced diameter resilient ring 94, however, impedes this upward motion, and generally will prevent upward travel of the ball 90 so long as the upward pressure differential on ball 90 is not sufficient to squeeze it back upward through the resilient ring 94.

The particular cement plug 42 illustrated in FIG. 1B includes two plug cups 96 and 98. The upper plug cup 96 is attached to the plug mandrel 80, and the lower plug cup 98 is mounted on a plastic plug body 100 which itself is threadedly connected to the plug mandrel 80 at threads 102.

The cement head and plug assembly 10 further includes an equalizing valve means 104 which is disposed in the equalizing mandrel 54 of cement head body 20. The equalizing valve means 104 provides a means for permitting pressurized fluid trapped in an annular space 106 between the cement head body 20 and casing 14 above the upper cup 96 of plug 42 to communicate with the cement passage 22 so that fluid pressure can equalize between the annular space 106 and the cement passage 22.

The equalizing valve means 104 includes an equalizing port 108 which is disposed through a side wall of equalizing mandrel 54. The equalizing valve means 104 further includes an annular elastomeric flapper 110 which is disposed within the equalizing mandrel 54 concentrically about the cement passage 22. The flapper 110 has an annular upper end 112 which is sealingly connected to an inner bore 114 of equalizing mandrel 54. A lower end 116 of annular flapper 110 extends freely downward and covers the equalizing port 108.

The upper end 112 of annular flapper 110 includes an annular end ring 118 which is sandwiched between an annular upward facing shoulder 120 of equalizing mandrel 54 and the lower end 62 of body mandrel 52. An annular 0-ring seal 122 is disposed in end ring 118 and seals against the bore 114 of equalizing mandrel 54.

An upper end of the body mandrel 52 is closed by an end plug 124 which can be removed to allow the releasing ball 90 to be placed in the spoon 93 releasing means 92.

EMBODIMENT OF FIG. 2

Figure 2:
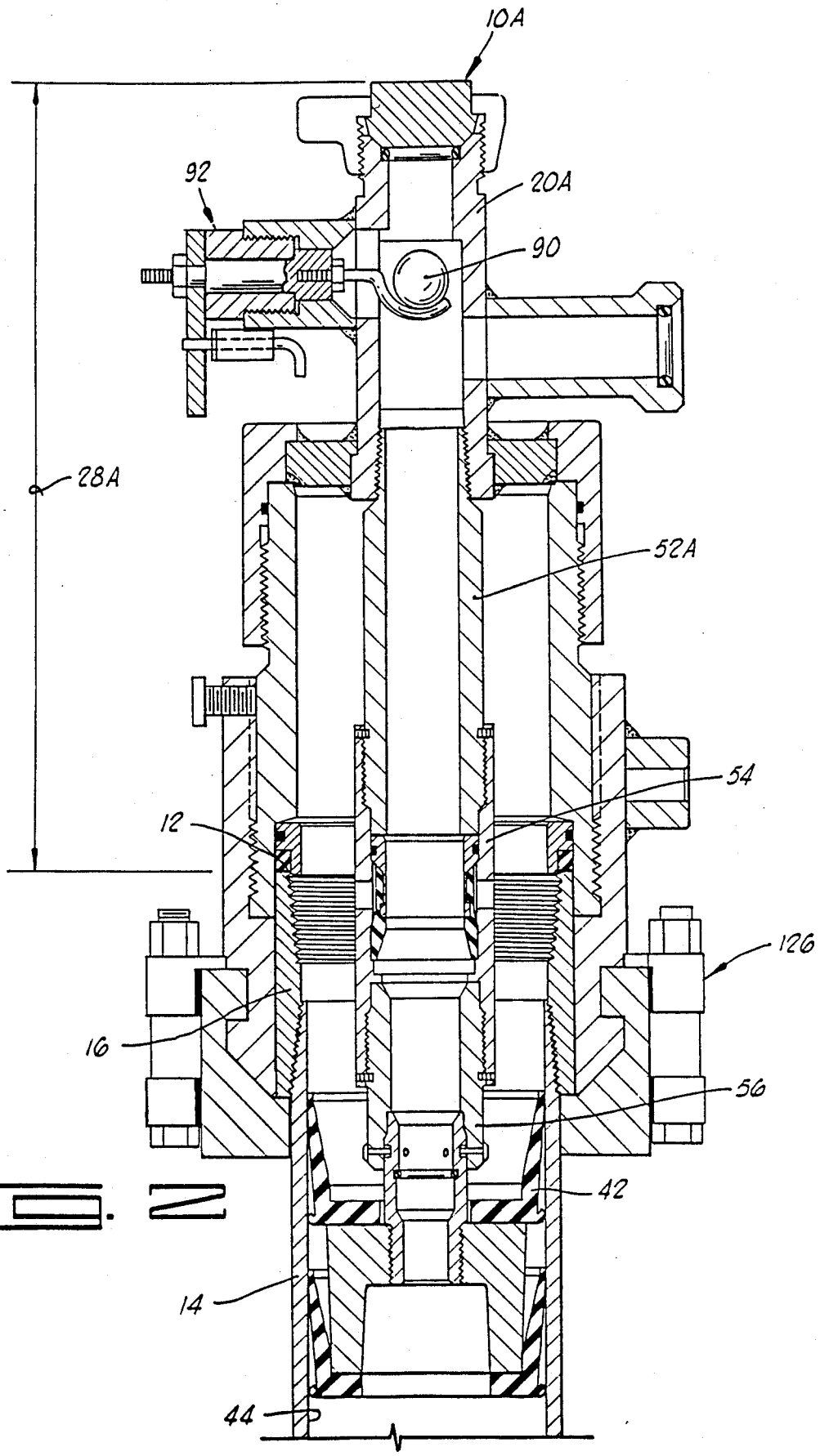
FIG. 2, is an elevation section view of an alternative embodiment of the present invention. The embodiment of FIG. 2 mounts upon the upper end of the well casing by clamping an annular clamping member about the casing collar at the upper end of the well casing.

Turning now to FIG. 2, an alternative embodiment of the present invention is thereshown. The primary difference between the embodiments of FIGS. 1A–1B and FIG. 2 is the means by which the cement head and plug assembly is mounted upon the well casing 14.

In the embodiment of FIG. 2, components substantially the same as those of FIGS. 1A–1B are indicated with like numerals, and modified components are indicated by a suffix A.

The cement head and plug assembly 10A of FIG. 2 includes a cement head body 20A which includes a body mandrel 52A, an equalizing mandrel 54, and a releasing mandrel 56.

The cement head body 20A is mounted on the well casing 14 by an annular clamping means generally designated by the numeral 126. The clamping means 126 clamps about the casing collar 16. The mounting means 126 is constructed in a fashion generally similar to that shown in U.S. Pat. No. 4,613,161 to Brisco, the details of which are incorporated herein by reference.

Otherwise, the general construction and operation of the cement head and plug assembly 10A is generally the same as that of the assembly 10 of FIGS. 1A–1B.

METHODS OF OPERATION

The methods of utilizing the cement head and plug assembly of either FIGS. 1A–1B or FIG. 2 to cement a casing in an oil or gas well are generally as follows.

First, the cement head and plug assembly 10 is assembled separate from the well casing 14.

Then, the cement plug 42 which can be described as being suspended from the cement head body 20 of assembly 10 is initially lowered into and located within bore 44 of casing 14 shortly below the upper end 12 of casing 14.

The cement head and plug assembly 10 is then mounted on the upper end of the casing 14 either by threaded engagement as shown in FIG. 1A, or with a clamping assembly 126 as shown in FIG. 2. Since the cement head and plug assembly 10 of the present invention suspends the cement plug 42 down in the casing 14 rather than containing it in a separate container located above the upper end 12 of casing 14, the assembly 10 can be constructed so that it extends only a relatively short distance 28 above the upper end 12 of casing 14 as compared to conventional cement plug containers.

Actual embodiments of the cement head and plug assemblies 10 and 10A designed by the assignee of the present invention have heights 28 and 28A of 17½ inches and 24 inches, respectively. The cement head and plug assemblies 10 and 10A can generally be described as preferably extending relatively short distances 28 and 28A above upper end 12 of casing 14 no greater than about 24 inches. This is contrasted to typical prior art plug containers which extend from about three feet to about six feet above upper end 12 of casing 14.

Then cement can be pumped down through the cement port 30 and through the cement head 10 into the well casing 14. The cement flows down through the well casing 14 and out the lower end thereof to fill an annulus between the well casing 14 and a well bore as is well known to those skilled in the art. This cement is pumped down through the cement plug 42 while the cement plug 42 remains suspended in the casing from the cementing head 20.

Then the plug passage 48 can be closed by dropping the releasing ball 90 so that it seats on the annular seat 88. The application of fluid pressure after the releasing ball 90 seats applies a sufficient force downward across the cementing plug 42 to shear the shear pins 46 thus releasing the cementing plug 42 so that it can be pumped downward into the casing along with the cement. When used in the manner just described, the cementing plug 42 is released after all of the cement has been pumped into the well casing, so that the cement plug 42 functions as a top plug which defines an upper level of cement in the casing 14 as the cement and plug 42 are pumped down into the casing 14.

It will be apparent that the apparatus of either FIGS. 1A–1B or FIG. 2 could be readily modified to add a bottom second plug shear pinned to the top plug 42 and actuated by a smaller releasing ball seating in a smaller annular seat in the bottom plug. Then, at the beginning of the cementing operation, a smaller releasing ball would be dropped to seat in the bottom plug thus shearing the bottom plug from the top plug so that the bottom plug would flow down with the lower boundary of the slug of cement. Then, the top plug 42 would be released in the manner previously described by dropping the larger releasing ball 90 to seat in the top plug 42.

Also, it will be apparent that other types of releasable retaining means rather than the shear pins 46 could be utilized. For example, collet spring fingers or the like with a latching and releasing mechanism could be utilized.

If during the operation of pumping cement down into the casing 14, some of the cement flows upward around the packer cups 96 and 98 into the annular space 106 and becomes trapped therein, the creation of any excessive pressure within the annular space 106 is prevented by the equalizing valve means 104. This excess pressure is allowed to bleed through the equalizing port 108 and out under the elastomeric flapper valve 110 into the cementing passage 22. It will be apparent that the flapper valve 110 acts as a check valve and prevents the flow of cement from the cementing passage 22 out through the equalizing port 108.

In the absence of the equalizing valve 104, there would be a danger that cement or other pressurized fluid trapped in the annular space 106 could exert a downward pressure across the entire area of the cementing plug 42 thus causing a premature shearing of the shear pins 46 and premature releasing of the plug 42.

After the releasing ball 90 has been seated within the annular seat 88 and the plug 42 has been released from the cement head body 20 and is moving down through the casing 14, the ball 90 is retained within the plug 42 by the ball retainer means 94. If pressure surges are encountered below the plug 42, the ball retainer means 94 will generally prevent the ball 90 from traveling upward out of the plug 42.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts may be made by those skilled in the art, which changes are encompassed within the scope and spirit of the present invention as defined by the appended claims.

What is claimed is:

1. A cement head and casing assembly comprising:

a well casing having an upper end extending above a ground level of a land based well;

a cement head body having a cement passage defined therethrough, said body having a lower portion extending down into said casing and having a upper portion extending a relatively short distance of no greater than about 24 inches above said upper end of said casing, said body including a cement port means communicated with said cement passage for introducing cement into said cement passage;

mounting means for mounting said cement head body on said upper end of said well casing;

a cement plug, closely received within a bore of said casing below said upper end thereof, said plug being releasably connected to said lower portion of said cement head body so that said plug is suspended from said lower portion of said body within said casing, said cement plug having a plug passage defined therethrough which is communicated with said cement passage so that cement can be pumped into said cementing port means, then through said cement passage, then through said plug passage down into said casing; and release means for closing said plug passage and releasing said plug from said body.

2. The assembly of claim 1, further comprising:

equalizing valve means, operably associated with said body, for permitting pressurized fluid located between said body and said casing bore above said plug to communicate with said cement passage and equalize therewith without permitting cement to flow from said cement passage out through said equalizing valve means.

3. The assembly of claim 2, wherein said equalizing valve means comprises:

an equalizing port disposed through said body; and an annular elastomeric flapper disposed in said body concentrically about said cement passage, said flapper having an annular upper end sealingly connected to said body and having a lower end extending freely downward and covering said equalizing port.

4. The assembly of claim 3, wherein:

said body includes an upper first tubular member and a lower second tubular member threadedly connected together, said lower tubular member having an upwardly facing annular shoulder defined therein;

said upper end of said annular elastomeric flapper includes an annular end ring which is sandwiched between said shoulder of said lower second tubular member and a lower end of said upper first tubular member; and said equalizing port is disposed through a side wall of said lower second tubular member.

5. The assembly of claim 1, wherein:

said plug includes a plug mandrel which is frangibly connected to said lower portion of said body, said plug mandrel having an annular seat defined therein for sealingly receiving a releasing ball of said release means therein.

6. The assembly of claim 5, wherein:

said plug includes a ball retainer means for preventing said releasing ball from traveling upward out of said plug mandrel after said releasing ball is seated on said annular seat.

7. The assembly of claim 6, wherein:

said ball retainer means is a resilient annular ring located in said plug mandrel above said annular seat so that said releasing ball must pass downward through said resilient ring to reach said annular seat, said resilient ring having an inside diameter smaller than an outside diameter of said releasing ball.

8. The assembly of claim 1, wherein:

said mounting means is an annular threaded mounting ring attached to said body and threadedly engaged with a casing collar defining said upper end of said well casing.

9. The assembly of claim 1, wherein;

said mounting means is an annular clamping means which clamps about a casing collar defining said upper end of said well casing.

10. A method of cementing a casing in a land based well, said method comprising the steps of:

(a) suspending a cementing plug from a cementing head so that said cementing plug is initially located within a bore of said casing below an upper end of said casing:

(b) mounting said cementing head on said upper end of said casing with said plug suspended in said casing and with said cementing head extending only a relatively short distance of no greater than about 24 inches above said upper end of said casing;

(c) pumping cement into said cementing head and down through a plug passage through said plug into said casing while said plug remains suspended in said casing from said cementing head;

(d) closing said plug passage and releasing said plug from said cementing head; and (e) pumping said plug down into said casing along with said cement.

11. The method of claim 10, wherein:

step (d) is further characterized as occurring after all of said cement has been pumped into said casing so that said plug functions as a top plug to define an upper level of cement in said casing as said cement and plug are pumped down into said casing in step (e).

12. The method of claim 10, further comprising a step of:

during step (c), equalizing any fluid pressure trapped between said cementing head and said casing above said plug with internal cement pressure within said cementing head.

13. The method of claim 10, wherein:

step (d) is further characterized as dropping a releasing ball into said plug passage to close said plug passage; and said method further includes a step of preventing said releasing ball from traveling upward out of said plug passage after said releasing ball closes said plug passage.

* * * * *